United States Patent [19]

Freisinger et al.

[11] Patent Number: 4,957,305

[45] Date of Patent: Sep. 18, 1990

[54] BINDING FOR CROSS-COUNTRY SKI

[75] Inventors: Henry Freisinger; Karl Stritzl, both of Vienna; Franz Luschnig, Traisksirchen, all of Austria

[73] Assignee: TMC Corporation, Switzerland

[21] Appl. No.: 404,056

[22] Filed: Sep. 8, 1989

Related U.S. Application Data

[62] Division of Ser. No. 153,835, Dec. 18, 1987, Pat. No. 4,900,053.

[30] Foreign Application Priority Data

Apr. 30, 1986 [AT] Austria ..... 1163/86

[51] Int. Cl.[5] ..... A63C 9/081

[52] U.S. Cl. ..... 280/618; 280/628; 280/634

[58] Field of Search ..... 280/617, 618, 620, 628, 280/630, 631, 632, 634, 636

[56] References Cited

U.S. PATENT DOCUMENTS

| | | | |
|---|---|---|---|
| 3,610,650 | 10/1971 | Korger et al. | 280/11.35 T |
| 3,620,545 | 11/1971 | Korger et al. | 280/11.35 T |
| 3,649,037 | 3/1972 | Vouthier | 280/628 |
| 4,165,883 | 8/1979 | Wiegl et al. | 280/618 |
| 4,226,439 | 10/1980 | Kirsch | 280/628 |
| 4,230,338 | 10/1980 | Wiegl et al. | 280/618 |
| 4,266,806 | 5/1981 | Wiegl et al. | 280/618 |
| 4,337,965 | 7/1982 | Salomon | 280/628 |
| 4,553,772 | 11/1985 | Boussemart et al. | 280/628 |
| 4,681,338 | 7/1987 | Spitaler | 280/628 |

FOREIGN PATENT DOCUMENTS

| | | | |
|---|---|---|---|
| 352599 | 9/1979 | Austria | 280/628 |
| 359409 | 11/1980 | Austria . | |
| 376898 | 1/1985 | Austria . | |
| 380174 | 4/1986 | Austria . | |
| 381033 | 8/1986 | Austria . | |
| 1703719 | 1/1971 | Fed. Rep. of Germany . | |
| 3412887 | 10/1984 | Fed. Rep. of Germany | 280/628 |
| 3443243 | 6/1985 | Fed. Rep. of Germany . | |
| 2405723 | 5/1979 | France . | |
| 2411019 | 7/1979 | France . | |
| 2548032 | 7/1983 | France . | |
| 488467 | 5/1970 | Switzerland . | |

*Primary Examiner*—Charles A. Marmor
*Assistant Examiner*—Brian L. Johnson
*Attorney, Agent, or Firm*—Finnegan, Henderson, Farabow, Garrett & Dunner

[57] ABSTRACT

The present invention relates to a heel-holder for a safety ski binding, the heel-holder comprising a snap-in device and a sole-holder vertically pivotable about a cross-pin disposed in a housing. The housing is horizontally pivotable about a raised pin formed on a base plate which is mounted on a ski. The snap-in device is loaded by a spring. The snap-in device includes a snap-in rocker pivotably mounted on the housing and a control member pivotably mounted on the snap-in rocker. The snap-in rocker engages a control cam formed on the sole-holder, and the control member engages an extension of the base plate. The spring loads the snap-in device and applies a force for releasing the binding. The snap-in device reduces the spring force required for releasing the binding during both the vertical pivoting of the sole-holder and the horizontal pivoting of the housing. According to further embodiments, the base plate extension may be fixed to a pivot plate which is supported on the base plate and which is horizontally pivotable with respect to the ski.

3 Claims, 7 Drawing Sheets

BINDING FOR CROSS-COUNTRY SKI

This application is a division of application S.N. 153,835 filed Dec. 18, 1987, now U.S. Pat. No. 4,900,053.

BACKGROUND OF THE INVENTION

1. Field of the Invention

The present invention relates to a heel-holder for a safety ski binding.

2. Description of the Related Art

A heel-holder for a safety ski binding is disclosed in German Offenlegungsschrift No. 17 03 719. This safety ski binding releases the ski boot both horizontally and vertically. The binding includes a spring-loaded snap-in device cooperating with two snap-in elements. One of these snap-in elements locks the binding against vertical motion, the other against lateral motion. If a load is applied in one direction, the corresponding snap-in element for that direction forces the snap-in device back against the force of the spring and thereby reduces the spring force required for release of the heel-holder when pivoting motion occurs in the direction orthogonal thereto. However the motion in the one direction requires the loosening of the snap-in element in the other direction because the snap-in device moves away from its corresponding snap-in element. Accordingly when a single snap-in device is used which includes a snap-in element for vertical motion and one for horizontal motion, difficulties are encountered in adjusting the two snap-in processes.

Austrian Pat. No. 380,174 discloses a heel-holder with a housing and a snap-in mechanism which pivots against the force of a spring about a vertical pin fixed to a base plate, which is in turn fixed to a ski. The snap-in mechanism includes two levers, both pivoting about the same pivot in the housing. One lever controls horizontal pivoting and the other lever controls vertical pivoting. The lever controlling horizontal pivoting is disposed in a recess of the lever controlling the vertical pivoting. Both levers pivot about the same pivot. The lever controlling the horizontal pivoting is spring-loaded and includes a control cam cooperating with a roller mounted on an extension of the base plate. This arrangement requires three springs.

The object of the invention is to provide a safety ski binding having a controlled vertical and horizontal release which is free of the drawbacks of the above-described bindings.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

SUMMARY OF THE INVENTION

To achieve the foregoing objects, and in accordance with the purposes of the invention as embodied and broadly described herein, there is provided a heel-holder for a safety ski binding comprising a base plate adapted to be mounted to the upper surface of a ski, the base plate including a raised pin at one end and at least one extension at the other end thereof; a housing horizontally pivotable about the raised pin, the housing including a cross-pin provided in the upper part thereof;

a sole-holder vertically pivotable about the cross-pin, the sole holder including a hollow portion housing a control cam on an upper wall of the hollow portion; a snap-in device provided in the housing, the snap-in device comprising a snap-in rocker pivotably mounted in the housing about a pivot pin arranged parallel to the cross pin and a control member pivotably mounted on the snap-in rocker and perpendicular to the pivot pin, the snap-in rocker engaging the control cam of the sole-holder and the control member engaging the at least one base plate extension; and a spring for loading the snap-in device, the spring being capable of applying a force for releasing the binding, the snap-in device reducing the spring force necessary for releasing the binding during both the vertical pivoting of the sole-holder and the horizontal pivoting of the housing.

BRIEF DESCRIPTION OF THE DRAWINGS

The accompanying drawings which are incorporated in and constitute a part of of the specification, illustrate presently preferred embodiments of the invention and, together with the general description given above and the detailed description of the preferred embodiment given below serve to explain the principles of the invention.

Figure 8:
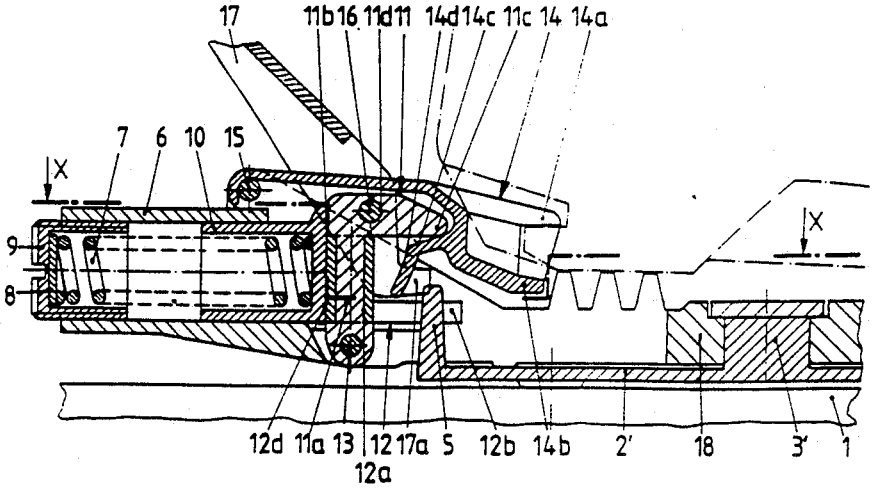
Figure 9:
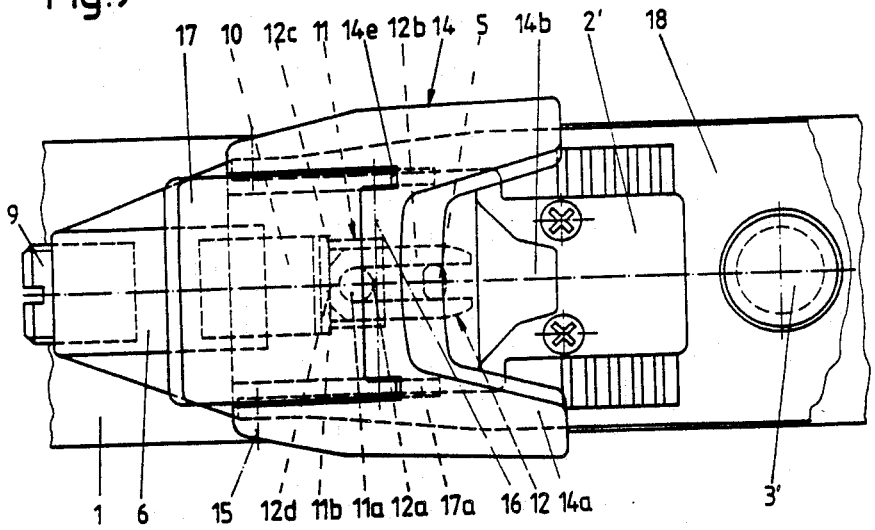
Figure 10:
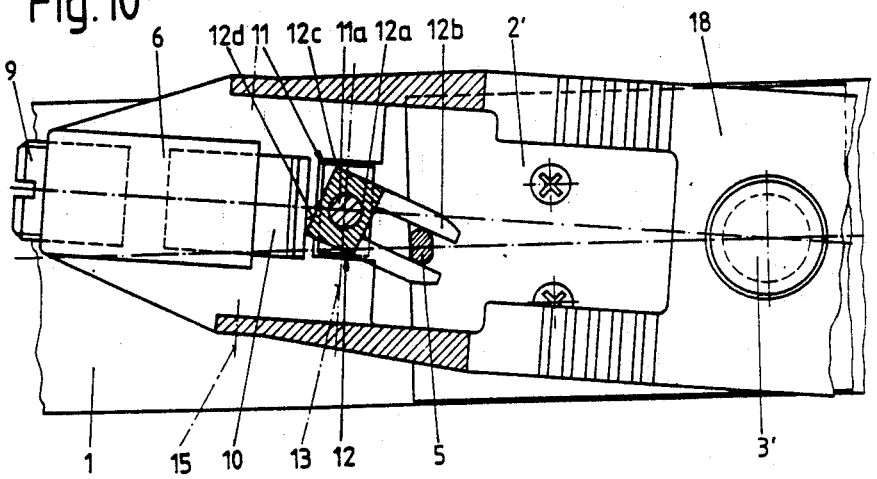
Figure 12:
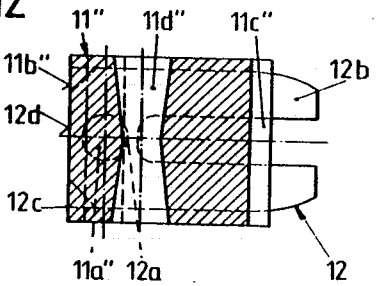
Figure 11:
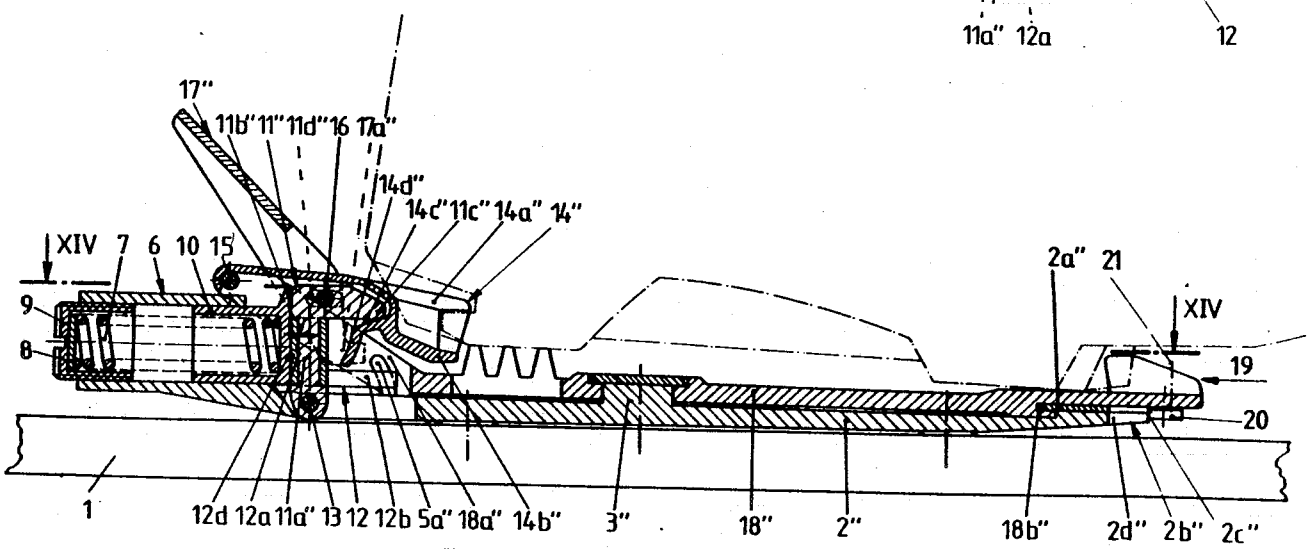
Figure 13:
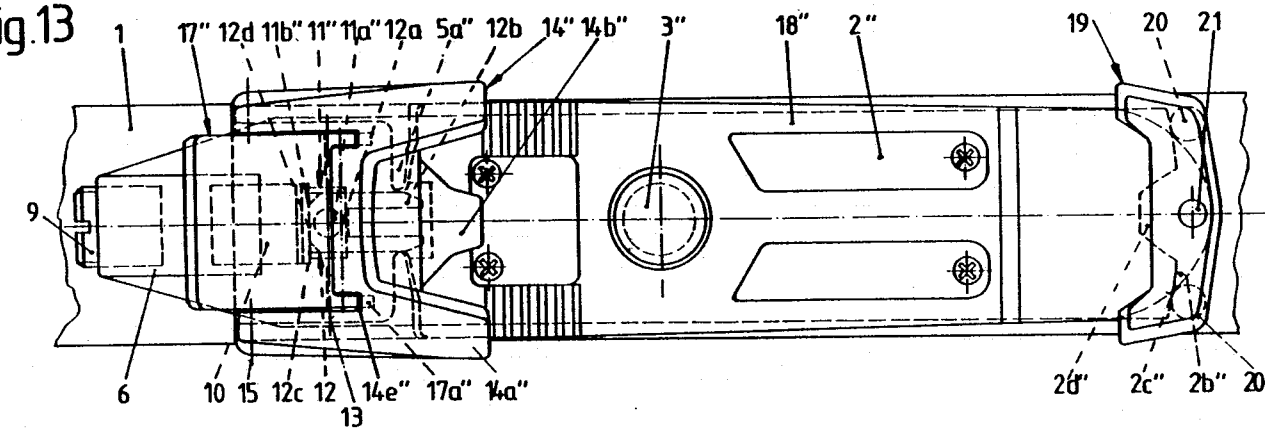

FIGS. *7a–d* are detailed views of the snap-in rocker and the control member of the present invention;

FIG. 8 is a cross-sectional view of a second embodiment of the present invention;

FIG. 9 is an elevational view of the heel-holder of FIG. 8;

FIG. 10 is an elevational view of the heel-holder of the present invention taken along line X—X of FIG. 8 following horizontal pivoting of the housing;

FIG. 11 is a cross-sectional view of a third embodiment of the present invention illustrating a heel-holder including a toe-holder and a sole-holder where the sole-holder pivots about a pivot plate;

FIG. 12 is an enlarged elevational view of the snap-in rocker taken along the plane of a bore formed therein;

FIG. 13 is an elevational view of the heel-holder of FIG. 11; and

Figure 14:
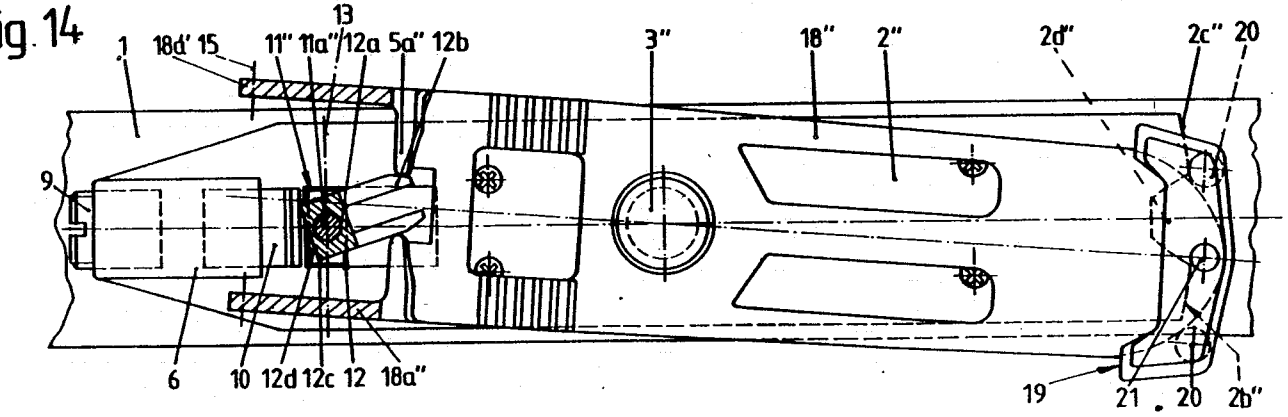

FIG. 14 is an elevational view of the heel-holder of FIG. 11 taken along with XIV—XIV of FIG. 11 following horizontal pivoting of the housing.

DESCRIPTION OF THE PREFERRED EMBODIMENTS

Reference will now be made in detail to the present preferred embodiments of the invention as illustrated in the accompanying drawings.

In accordance with the present invention there is provided a heel-holder for a safety ski binding. FIGS. 1–7*d* illustrate the heel-holder according to a first embodiment of the present invention. As shown in FIGS. 1–4, a base plate 2 is mounted by screws (not shown) to the upper side of a ski 1. The base plate supports a raised pin 3 at the rear of the plate and a circular cross-rail 4 at the front of the plate i.e., the end of the plate nearer the ski boot. An extension 5 comprising a vertical stud is located along the central longitudinal axis of the base plate 2.

A housing 6 including a bottom 6*a* is pivotably supported on the raised pin 3 at the rear of the bottom 6*a*. The pivoting motion of the housing is in the horizontal plane, whereby the bottom 6*a* is guided at the front of the housing by the cross rail 4. Hence the housing 6 is secured against lifting from the base plate 2.

The housing 6 houses a snap-in device loaded by a spring 7 and including a snap-in rocker 11 and a control member 12. The end of the spring 7 opposite the snap-in device rests on a spring cap 8. The spring can be adjusted by a setting mechanism 9 which is adjustable by a thread in the housing 6 so as to regulate the spring force. The other end of the spring 7 near the snap-in device rests on a support 10 which is displaceable within the housing 6. The snap-in rocker 11, when viewed from the side, is L-shaped in configuration. The snap-in rocker 11 includes a vertical bar and a horizontal bar, the vertical and the horizontal bars each having a free end and a fixed end. The snap-in rocker 11 is mounted at the front end of the housing bottom 6*a* by the free end of the vertical bar to a pivot pin 13. The central point of the vertical bar comprises a pivot point for the control member 12. The free end of the horizontal bar of the snap-in rocker comprises a snap-in protrusion 11*c*. The control member 12 is also L-shaped in configuration when viewed from the side and is U-shaped in configuration when viewed from above. The control member 12 includes a vertical leg 12*d* and a pair of horizontal legs 12*b*. The vertical leg has a longitudinal bore 12*a* engaged by the central point of the snap-in rocker 11. The extension 5 of the base plate 2 rests between the horizontal legs 12*b*. Edges 12*c* of the control member 12 facing the support 10 are increasingly chamfered as shown in FIGS. 7*a–d*. FIGS. 7*a–d* represent respectively, the side view, the top view and the elevational view of the snap-in device, and the perspective of the control member 12. The sides of the vertical bar of the snap-in rocker 11 facing the support 10 and the sides of the vertical leg of the control member 12 facing the support 10 serve as rest surfaces 11*b* and 12*d*, respectively, for the support 10.

Figure 1:
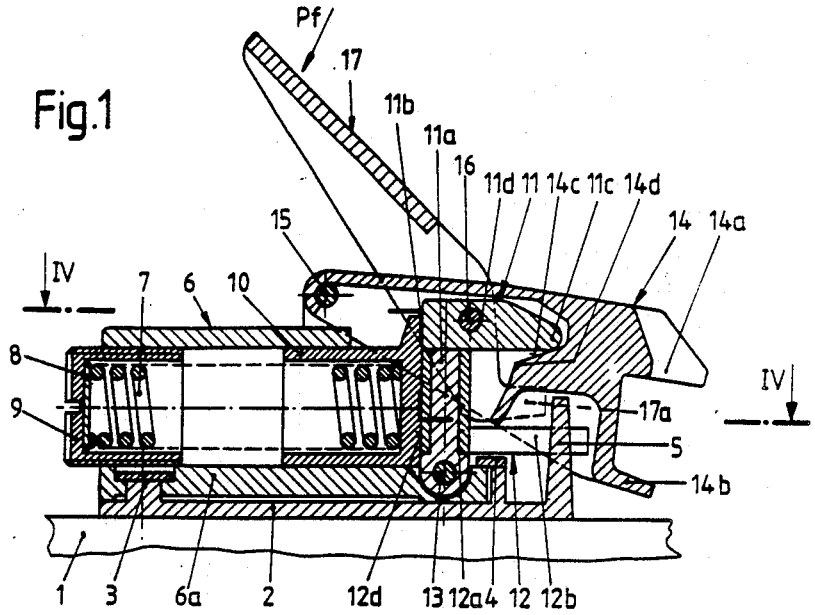
FIG. 1 is a cross-sectional view of the heel-holder of the present invention with the heel of a ski boot in place on a ski.
Figure 2:
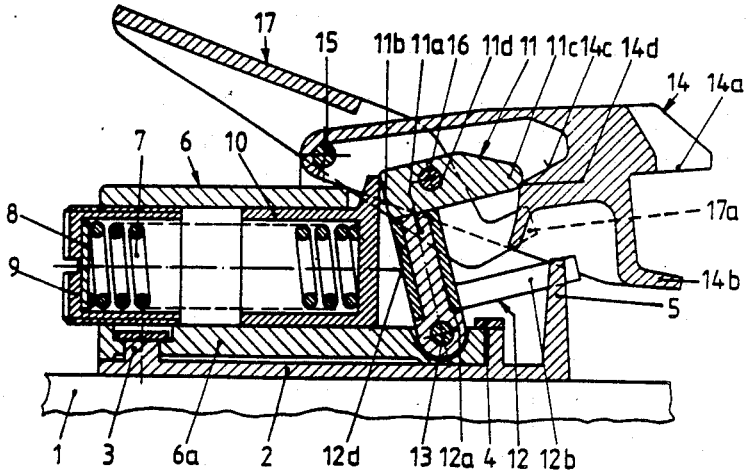
FIG. 2 is a cross-sectional view of the heel holder of FIG. 1 following vertical pivoting of the sole-holder.
Figure 2A:
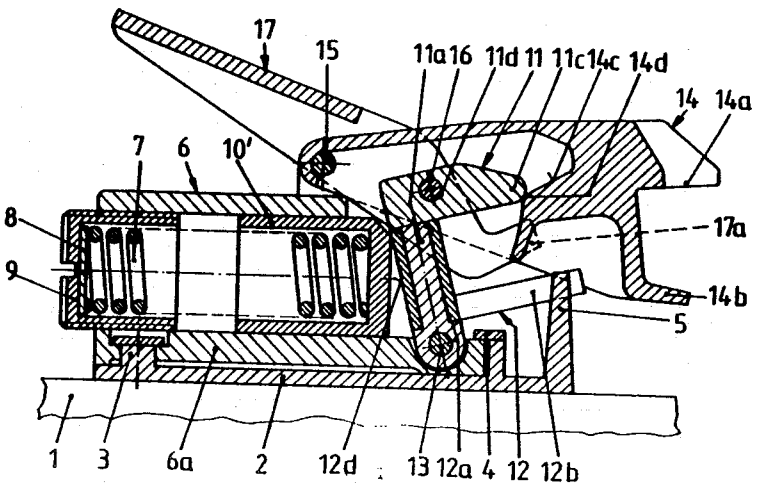
FIG. 2*a* is a variation of the first embodiment shown in FIG. 2.

A sole-holder 14 for holding the sole of a ski boot is equipped at its front end with a sole depressor 14*a* and a stepping spur 14*b*. The sole-holder 14 is pivotably supported by a cross-pin 15 provided in the upper part of the housing 6. The upper wall of the sole-holder 14 is provided with a control surface which is shown in FIGS. 1, 2 and 2*a* as a control cam 14*c*. The control cam 14*c* includes an upper portion and a lower portion, the portions intersecting at the release point 14*d* of the heel-holder. The snap-in rocker 11 rests by the snap-in protrusion 11*c* against the cam 14*c*.

The horizontal bar of the snap-in rocker 11 includes a bolt 16 held in a bore 11*d* at the center of the bar. A release lever 17 pivots on the bolt 16 and includes a short, U-shaped arm which engages the lower part of the sole-holder 14. Slotted clearances 14*e* formed in the sole-holder 14 allow pivoting of the release lever 17. This design is known in the art and does not in itself comprise the present invention.

Figure 3:
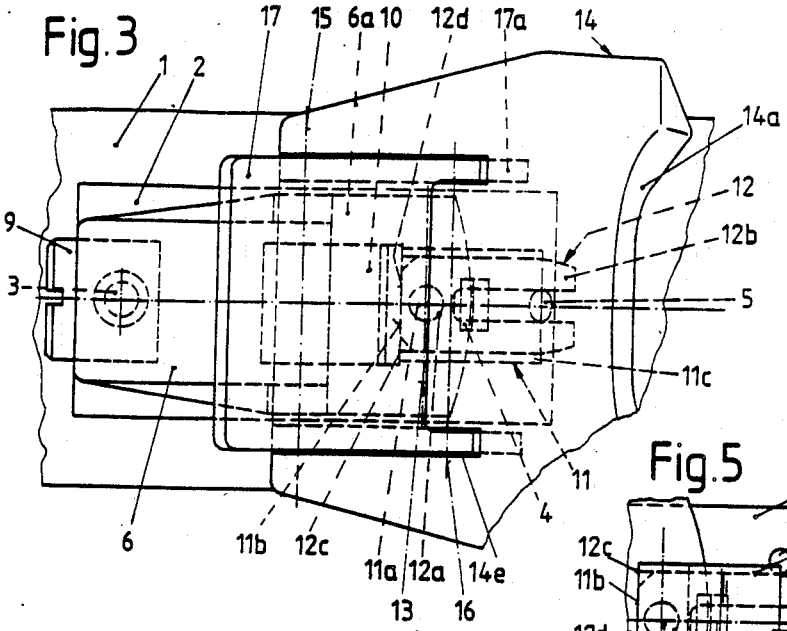
FIG. 3 is a elevational of the heel-holder of FIG. 1.

When the heel-holder of the present invention holds the heel of the ski boot down against on the ski as shown in FIGS. 1 and 3, the rest surfaces 11*b* and 12*d* of the snap-in rocker 11 and the control member 12, respectively, rest against the support 10. Also, the snap-in protrusion 11*c* contacts the upper portion of the cam 14*c*, while the extension 5 of the base plate 2 is aligned with the central longitudinal plane of the housing 6. If the sole-holder 14 is pivoted vertically upward, then the snap-in device, including the snap-in rocker 11 and the control member 12, is pivoted about the pivot pin 13 against the force of the spring 7 toward the rear of the ski and the extension 5 remains in engagement with the horizontal legs 12*b* of the U-shaped control member 12.

Figure 5:
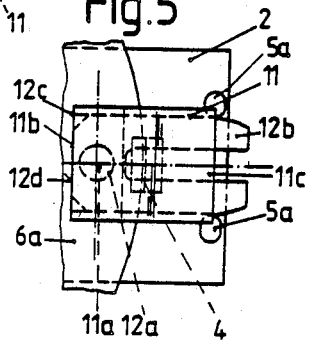
FIG. 5 is an elevational view of the snap-in device of the present invention where the base plate of the heel-holder including two extensions.
Figure 4:
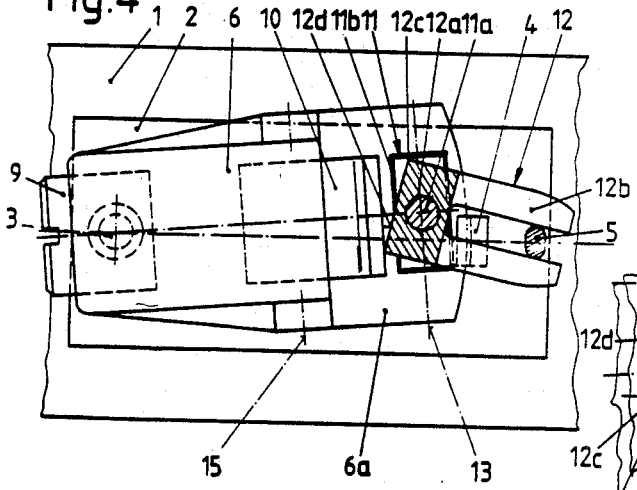
FIG. 4 is an elevational view of the heel-holder taken along the line IV—IV of FIG. 1 following horizontal pivoting of the housing, the sole-holder and a release lever being omitted.
Figure 6:
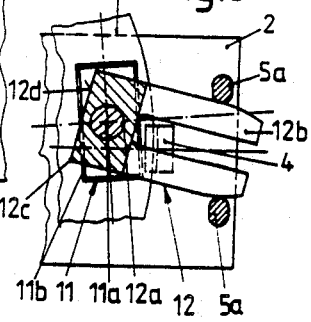
FIG. 6 is a elevational view of the snap-in device of FIG. 5 following horizontal pivoting of the housing.
Figure 7A:
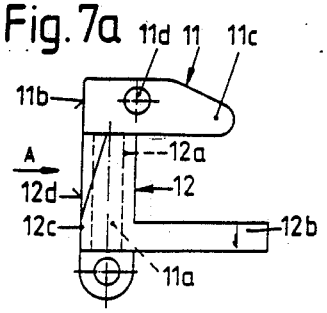
Figure 7C:
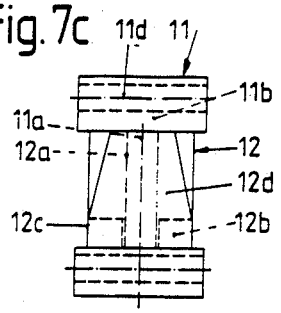
Figure 7B:
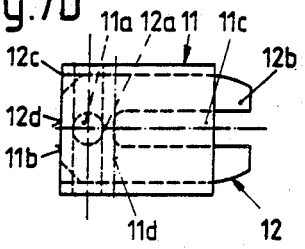
Figure 7D:
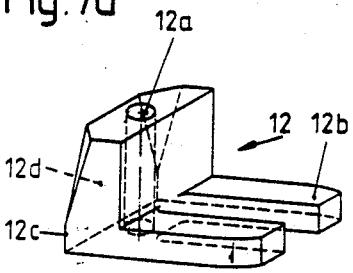

The position of the sole-holder at the release point 14*d* is shown in FIG. 2. After the sole-holder 14 has passed the release point 14*d* as shown in FIG. 4, the sole-holder 14 pivots upwardly on account of an opening spring (not shown). If only a lateral force is applied to the sole-holder 14, then housing 6 and sole-holder 14 pivot horizontally about the raised pin 3. It is clear in this respect from FIG. 4 that due to its motion relative to the extension 5, the control member 12 pivots about the central point 11*a* of the vertical bar the snap-in rocker 11 against the force of spring 7. FIGS. 5 and 6 show the details of the snap-in device wherein the base plate 2 includes a plurality of extensions comprising two vertical studs 5*a*.

According to the present invention, if the load applied to the binding is diagonal, i.e., it has both a vertical and a horizontal component, the release of the binding will be controlled. The spring 7 applies a force for releasing the binding upon pivotal movement in one of the vertical and horizontal directions. The snap-in device reduces the spring force required for releasing the binding in the other direction without the retaining action of the spring in the other direction being lost. If the diagonal load is resolved into its components, then if there is horizontal pivotal movement of the housing 6, spring 7 will be compressed on account of the relative motion of the control member 12 of the snap-in device and the extension 5 of base plate 2. Upon the ensuing vertical rotation, the snap-in rocker 11 is almost motionless and comes to rest against the support 10 and against the chamfered edges 12*c* of the control member 12. The support 10 then pushes against the force of the spring 7 until the snap-in protrusion 11*c* passes the release point 14*d*, whereupon the sole-holder 14 is released.

To open the heel-holder manually or using a ski pole, a force is exerted in the direction of the arrow Pf on the release lever 17. The release lever 17, at its shorter arm 17*a*, engages underneath the sole-holder 14 and raises it at least to where the snap-in protrusion 11*c* of the snap-in rocker 11 passes the release point 14*d*, whereupon the sole-holder 14 is pivoted upwardly by the opening spring. Following either a safety release or a manual opening, the heel holder is ready for use again. By stepping into the ski and forcing the sole holder 14 down with the boot, the heel-holder is then closed.

A variation of the first embodiment is shown in FIG. 2*a*. This variation includes a slightly modified support 10′ for the spring 7 assuring that the control 12 is loaded by the spring 7 in any position. In this case the edges of the control member 12 that face the support 10′ may be rounded to lower the stress on and consequently wearing of the edges.

A second embodiment of the present invention is shown in FIGS. 8–10. In this embodiment, the sole-holder is used in conjunction with a pivot plate supported on the binding plate. The heel-holder of second embodiment of FIGS. 8–10 comprises an extension 5 at the rear end of a base plate 2' which is fixed to the ski. The heel-holder further comprises pin 3' provided at the center of base plate 2'. The raised pin 3' pivotably supports a pivot plate 18 which is preferably pre-stressed by a return spring (not shown). The pivot plate 18 comprises at its rear end a housing 6 with a spring-loaded snap-in device. A sole holder 14 and a release lever 17 similar to the first embodiment are also provided.

The vertical release of the sole-holder takes place in the same way as in the first embodiment. If there is a lateral force, the pivot plate 18, together with the housing 6, the snap-in device and the sole holder 14, pivots about the raised pin 3'. Due to relative motion of the control member 12 snap-in device with respect to the extension 5 binding plate 2', the spring 7 will be compressed, as described above in the first embodiment.

A complete binding including a toe-holder which provides for horizontal release will now be described in relation to a third embodiment of the present invention. The heel-holder according to the third embodiment of the present invention is shown in FIGS. 11–14 and comprises a base plate 2' fixed to the ski and a raised pin 3'' at the center of the base plate which pivotably supports a pivot plate 18''. The base plate 2' is provided at its rear end with a housing 6 comprising a spring-loaded snap-in device similar to that of the first embodiment. The snap-in device comprises a snap-in rocker 11'' and a control member 12. The pivot plate 18'' extends in two sidewalls **18*a*'' to the rear of the heel-holder from the extensions 5*a*''. A sole-holder 14'' is vertically pivotable about a cross-pin 15. The front region of the pivot plate 18'' is provided at its underside with a guide groove 18*b*''. The guide groove 18*b*'' is engaged by a plate 2*a*'' mounted on the front part of the base plate 2''. A release lever 17'' pivots about a bolt 16 disposed in the snap-in rocker 11''. The snap-in rocker 11'' includes an hour-glass bore 11*d*'' in which the bolt 16 is disposed. The bore is shown in detail in FIG. 12. Because the sole holder 14'' can move horizontally relative to the snap-in rocker 11'' as part of the pivot plate 18'', the control surface shown in cam 14*c*'' in FIG. 11 is made correspondingly wide. Also, the release lever 17'' is designed to be wide enough to allow the pivotal motion of the pivot plate 18'' The release lever 17'' is carried along when the pivot plate 18'' is pivoted, on account of the slotted clearances 14*e*'' in the sole-holder 14''**.

The vertical release of the sole-holder takes place in the same manner as in the first embodiment. When there is a lateral force, the pivot plate 18'' pivots and by means of the two extensions **5*a*'' pushes the control member 12 against the force of the spring 7. The sole-holder 14'' and the release lever 17'' are pivoted along with the pivot plate 18''. Because the snap-in rocker 11'' pivots on the housing 6, which is attached to the end of the base plate 2'', snap-in protrusion 11*c*'' formed on the snap-in rocker 11 "rides along the release lever 17''. The horizontal plane of the bore 11*d*'' of the snap-in rocker 11'' defines the release position for the bolt 16**.

The mechanism for the simultaneous horizontal and vertical release of the heel-holder is the same as in the previous embodiments. If the pivotal movement is purely horizontal, the heel-holder is dimensioned in such a way that release will take place only beyond a given angle of rotation. This release takes place before the control member 12 has compressed the spring 7 so much by its rotation that the snap-in rocker 11'' is also not loaded by the spring. Accordingly, the heel-holder, when overloaded, will release only in the vertical and diagonal directions.

FIGS. 11, 13, and 14 show the release mechanism of the front toe-holder 19. The toe-holder 19 is attached by a pivot bolt 21 on the pivot plate 18. In the toe-holder 19 release takes place by the cooperation of a control slide **2*b*'' disposed at one end of the base plate 2'' with two snap-in rollers 20 located at the underside of the toe-holder 19. The control slide 2*b*'' consists of an arcuate part 2*c*'' with a central raised pin 3'' and with a central clearance 2''. When the pivot plate 18'' is pivoted, the snap-in rollers 20 rests against the lowest point of the clearance 2*d*''. In that position, the ski boot is disengaged from the ski laterally at the toe-holder 19**.

The invention is not restricted to the embodiments shown. Further variations are conceivable which are within the scope of the invention. Two extensions may be used instead of one extension, it being essential only that the housing be displaceable relative to the base plate extensions regardless of whether the extensions are fixed to the ski or are fixed to a part which pivots horizontally relative to the ski. Also, the housing may be fixed to the ski and the base plate may be pivotable about a pin fixed to the ski. The sole-holder may thereby pivot either on the housing or on the binding plate.

In a known manner frictional forces may be reduced by placing friction-reducing elements of a suitable material between components which slide relative to each other. Alternatively, components may be coated with such a material. Also the extensions may be equipped with rollers.

The above described bindings are intended primarily for use with boots having a sole length that is uniform. If necessary, the toe-holder may be adjusted to match the binding to different sole lengths. Such matching is known, for example, as in Austrian Patent No. 352,599.

Additional advantages and modifications wil readily occur to those skilled in the art. The invention in its broader aspects is, therefore, not limited to the specific details, representative apparatus and illustrative example shown and described. Accordingly, departures may be made from such details without departing from the spirit or scope of the general inventive concept as defined by the appended claims and their equivalents.

We claim:

1. A heel-holder for a safety ski binding comprising:

a base plate adapted to be mounted to the upper surface of a ski, the base plate including a raised pin at an intermediate portion and at least one extension at a first end thereof;

a housing including a top wall and a bottom wall horizontally pivotable about the raised pin, the housing including a cross-pin disposed at said top wall;

a pivot plate integral with said housing and rotatable about said raised pin, said housing being located at a rear end of said pivot plate;

a sole-holder vertically pivotable about the cross-pin, the sole-holder including a hollow portion forming a control cam on an upper wall of the hollow portion;

a snap-in device for releasing the binding provided in the housing, the snap-in device comprising a snap-in rocker pivotably mounted in the housing about a pivot pin arranged parallel to the cross pin and a control member pivotably mounted on the snap-in rocker and perpendicular to the pivot pin, the control member being substantially U-shaped in configuration and including a pair of horizontal legs and a vertical leg joining the horizontal legs the snap-in rocker engaging the control cam of the sole-holder and the control member engaging the at least one base-plate extension; and a spring for loading the snap-in device, the spring being capable of applying a force or releasing the binding, wherein the snap-in device reduces the spring force required for releasing the binding during both vertical pivoting of the sole-holder and horizontal pivoting of the housing.

2. A heel-holder for a safety ski binding comprising:

a base plate adapted to be mounted to the upper surface of a ski, the base plate including a raised pin at an intermediate portion and a first and second extension at a first end thereof;

a pivot plate rotatable about said raised pin;

a housing integral with the pivot plate and including a top wall and a bottom wall horizontally pivotable about the raised pin, and including a cross-pin disposed at said top wall;

a sole-holder vertically pivotable about the cross-pin and supported by the first and second extensions, the sole holder including a hollow portion forming a control cam on an upper wall of the hollow portion;

a snap-in device for releasing the binding provided in the housing, the snap-in device comprising a snap-in rocker pivotably mounted in the housing about a pivot pin arranged parallel to the cross pin and a control member pivotably mounted on the snap-in rocker and perpendicular to the pivot pin the control member being substantially U-shaped in configuration and including a pair of horizontal legs and a vertical leg joining the horizontal legs the snap-in rocker engaging the control cam of the sole-holder and the control member engaging at least one of the first and second base-plate extensions; and a spring for loading the snap-in device, the spring being capable of applying a force for releasing the binding, wherein the snap-in device reduces the spring force required for releasing the binding during both vertical pivoting of the sole-holder and horizontal pivoting of the housing.

3. A heel-holder for a safety ski binding comprising:

a base plate adapted to be mounted to the upper surface of a ski, the base plate including a raised pin at an intermediate portion and at least one extension at a first end thereof;

a housing having a top wall and a bottom wall horizontally pivotable about the raised pin, the housing including a cross-pin disposed outside the top wall;

a sole-holder vertically pivotable about the cross-pin, the sole holder including a hollow portion forming a control cam on an upper wall of the hollow portion;

a snap-in device for releasing the binding provided in the housing, the snap-in device comprising a snap-in rocker pivotably mounted in the housing about a pivot pin arranged parallel to the cross pin and a control member pivotably mounted on the snap-in rocker and perpendicular to the pivot pin, the control member being substantially U-shaped in configuration and including a pair of horizontal legs and a vertical leg joining the horizontal legs the snap-in rocker including a bore having a substantially hourglass configuration in a horizontal cross-section and engaging the control cam of the sole-holder, the control member engaging the at least one base-plate extension; and a spring for loading the snap-in device, the spring being capable of applying a force for releasing the binding, wherein the snap-in device reduces the spring force required for releasing the binding during both vertical pivoting of the sole-holder and horizontal pivoting of the housing.

* * * * *